United States Patent [19]

Hain et al.

[11] Patent Number: 4,841,926

[45] Date of Patent: Jun. 27, 1989

[54] MULTI-CYLINDER INTERNAL COMBUSTION ENGINE WITH EXTERNALLY APPLIED IGNITION AND WITH TURBOCHARGER

[75] Inventors: Klaus Hain, Leonberg; Michael Beer, Wimsheim; Staas Gietzen, Obereisesheim, all of Fed. Rep. of Germany

[73] Assignee: Dr. Ing h.c.F. Porsche Aktiengesellschaft, Stuttgart, Fed. Rep. of Germany

[21] Appl. No.: 191,125

[22] Filed: May 6, 1987

[30] Foreign Application Priority Data

May 6, 1987 [DE] Fed. Rep. of Germany ..... 3715062

[51] Int. Cl.[4] ..... F02P 1/00

[52] U.S. Cl. ..... 123/146.5 A; 123/559.1; 123/146.5 R

[58] Field of Search ..... 123/146.5 A, 146.5 R, 123/559.1, 561, 563

[56] References Cited

U.S. PATENT DOCUMENTS

| | | | |
|---|---|---|---|
| 2,207,368 | 7/1940 | Arthur | 123/146.5 A |
| 2,798,109 | 7/1957 | Voigt | 123/146.5 R |
| 4,281,627 | 8/1981 | Sakurai | 123/146.5 A |
| 4,302,638 | 11/1981 | Fox et al. | 123/146.5 A |
| 4,348,993 | 9/1982 | Icno et al. | 123/146.5 A |
| 4,445,336 | 5/1984 | Inoue | 123/559.1 |
| 4,445,493 | 5/1984 | Coletti | 123/146.5 A |
| 4,505,340 | 10/1985 | Schrainor | 123/146.5 A |
| 4,512,296 | 4/1985 | Herrington et al. | 123/146.5 A |
| 4,666,383 | 4/1987 | Leonard | 123/559.1 |
| 4,719,883 | 1/1988 | Yokoyama et al. | 123/146.5 A |

*Primary Examiner*—Raymond A. Nelli

*Attorney, Agent, or Firm*—Barnes & Thornburg

[57] ABSTRACT

Sparks are generated in the ignition distributor of an internal combustion engine during the interruption of the high voltage current which lead to the formation of ozone. In order to remove this ozone causing strong oxidation and corrosion, rapidly out of the ignition distributor, the distributor housing is connected to the charging air line leading from the turbocharger to the cylinder head of the internal combustion engine and is scavenged by charging air.

5 Claims, 2 Drawing Sheets

MULTI-CYLINDER INTERNAL COMBUSTION ENGINE WITH EXTERNALLY APPLIED IGNITION AND WITH TURBOCHARGER

BACKGROUND AND SUMMARY OF THE INVENTION

The present invention relates to a multi-cylinder internal combustion engine with externally applied ignition that is supercharged by means of a turbocharger whereby the charging air is cooled in a charging air cooler prior to entry into the cylinder head of the internal combustion engine and whereby an ignition distributor is provided whose distributor housing surrounding the same is forcibly traversed by air flow.

Sparks occur in the ignition distributor of an internal combustion engine during the interruption of the high voltage current which lead to the formation of ozone and nitrogen oxide. The ozone has a strong oxidation effect and in case of protracted interaction causes corrosions at the electrical contacts and other metal parts of the ignition distributor. Also, the aging of the lubricating grease at the bearing places of the ignition distributor is accelerated by the ozone interaction in an undesired manner. One therefore aims to remove the thus-forming ozone as rapidly as possible out of the housing of the ignition distributor. According to the DE-OS No. 33 22 545, this takes place in that a blade rotor is secured on the distributor shaft, which discharges gases out of the ignition distributor through openings in the distributor housing into the atmosphere. Whereas at normal atmospheric pressure at sea level, this protective measure suffices, an increased danger of spark discharge or arcing exists at greater geodetic heights by reason of the smaller pressure of the atmospheric and the smaller air density in the distributor housing and therewith an increased danger of misfirings in the internal combustion engine.

It is therefore the object of the present invention to enable a still more effective air through-flow of the ignition distributor in an internal combustion engine with externally applied ignition and supercharged by means of a turbocharger which is particularly well-suited as drive aggregate for aircrafts at greater heights.

If, as solution to the underlying problem, the charging air line leading from the turbocharger to the cylinder head is connected to the distributor housing of the ignition distributor, then the inlet pressure to the distributor housing lies already at sea level above the atmospheric pressure. This pressure difference takes care that a good through-flow of the ignition distributor is assured.

In order to avoid a loss in charging air, in an advantageous construction according to the present invention, the distributor housing is so arranged in a by-pass line to the charging air cooler that the charging air branched off upstream of the charging air cooler again terminates in the charging air line downstream of the charging air cooler after flowing through the distributor housing. The pressure difference resulting at the charging air cooler is available for the through-flow. If the charging pressure is kept constant independently of the geodetic height in order to assure a constant power output of the internal combustion engine at all flight elevations, also the air density in the distributor housing has a constant value; spark discharges from the one to the other contact place can be avoided in this manner.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 1:
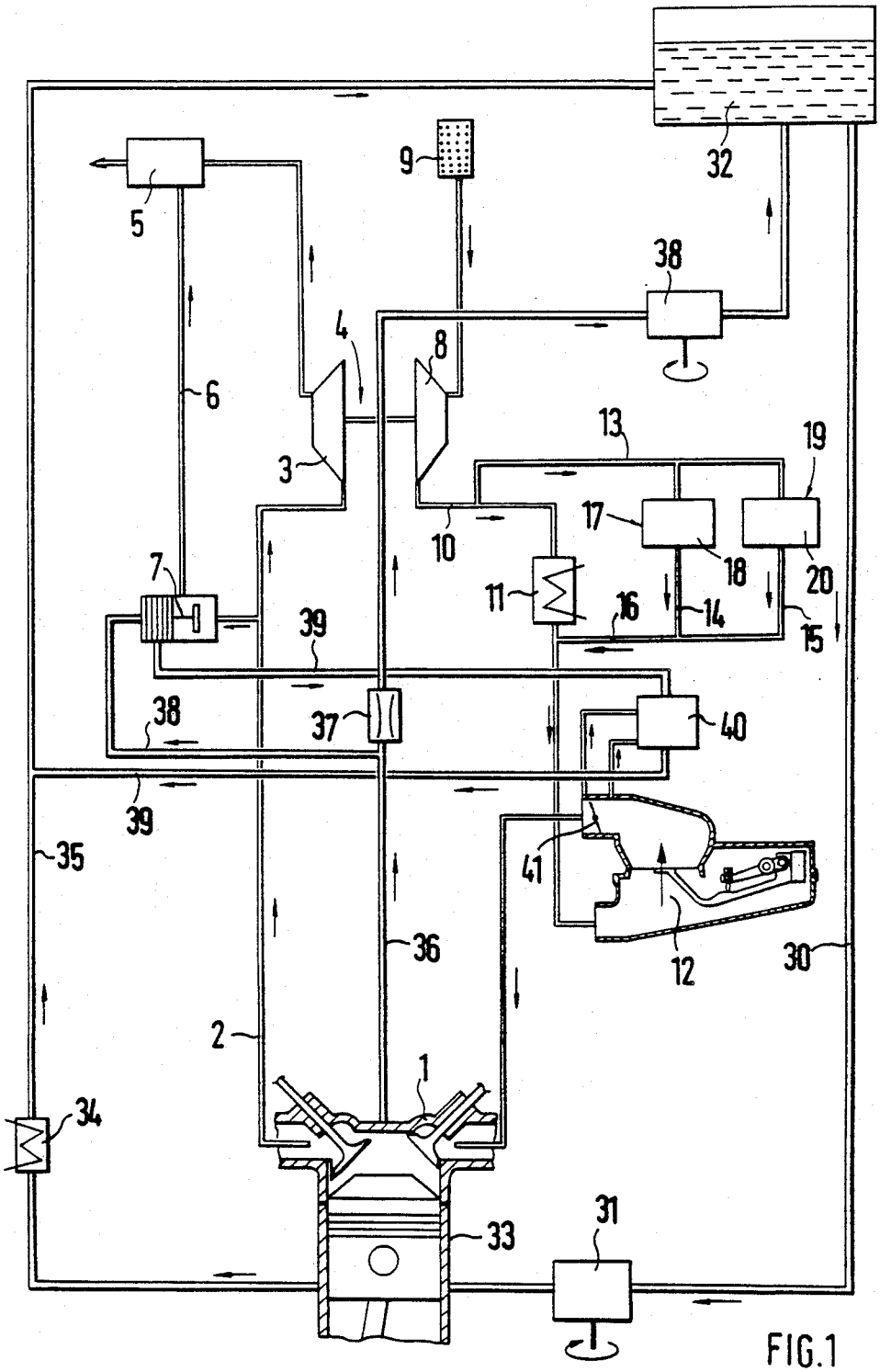
FIG. 1 is a schematic view of a multi-cylinder internal combustion engine with externally applied ignition and with a turbocharger arrangement in accordance with the present invention.

Referring now to the drawing wherein like reference numerals are used throughout the two views to designate like parts, and more particularly to FIG. 1, an exhaust gas line 2 leads from the cylinder head 1 of an internal combustion engine to the turbine 3 of an exhaust gas turbocharger generally designated by reference numeral 4 and from there into the atmosphere after flowing through a muffler or silencer 5. A by-pass line 6 is connected in parallel with the turbine 3, into which a by-pass valve 7 is inserted by way of which, depending on its position, more or less exhaust gas reaches the silencer 5 without acting upon the turbine 3.

The turbine 3 drives a compressor 8 by means of which air is sucked-in out of an air filter 9 and is supplied into a charging air line 10 with a pressure increase. The charging air line 10 leads by way of a charging air cooler 11 to an air quantity measuring device 12 controlling an injection system and from there to the cylinder head 1 of the internal combustion engine. A vent line 13 which branches off from the charging air line 10 upstream of the charging air cooler 11, is divided into lines 14 and 15 parallel in the flow direction and is then continued in a common line 16. The line 16 terminates in the charging air line 10, as viewed in the flow direction, downstream of the charging air cooler 11 and forms together with the vent line 13 by-pass line with respect to the charging air cooler 11. The distributor housing 17 of an ignition distributor 18 is inserted into the line 14 while the distributor housing 19 of a second ignition distributor 20 is interconnected into the line 15. Two ignition distributors are necessary if, as prescribed for aircraft engines, one operates with double ignition.

Figure 2:
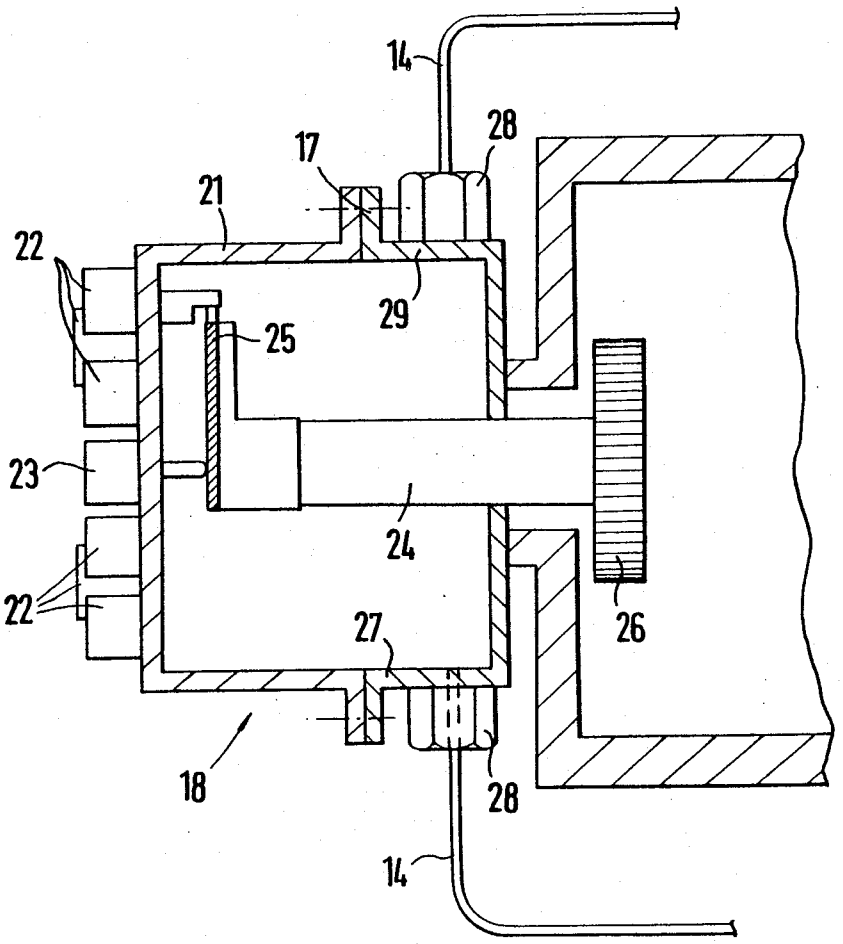
FIG. 2 is a somewhat schematic partial cross-sectional view illustrating the construction of an ignition distributor in accordance with the present invention.

The constructive realization of an ignition distributor generally designated by reference numeral 18 is schematically illustrated in FIG. 2. The distributor housing 17, which is installed in a lying position with horizontal axis, is closed off by a flangedly connected distributor cap 21. The ignition distributor 18 for a six-cylinder internal combustion engine contains in the bottom of the distributor cap 21 six ignition electrodes 22 and a center electrode 23 which contacts with an electrode 25 attached to the distributor shaft 24. The distributor shaft 24 is driven by way of a gear 26 from the internal combustion engine and applies by way of the rotating electrode 25 the high voltage generated by an ignition coil (not shown) at the rhythm of the ignition sequence of the cylinders by way of the ignition electrodes 22 to the spark plugs of the cylinders. The ozone produced during the interruption of the high voltage current by spark formation is removed out of the distributor housing 17 by the introduction of charging air. For that purpose, the line 14 is threadably connected to the bottom side 27 of the distributor housing 17 by means of a nut 28 and leaves at the top side 29 of the distributor housing. With the scavenging of the distributor housing 17, the water collecting at the bottom side 27 is at the same time torn along and removed from the distributor housing 17.

For the control of the hydraulically actuatable bypass 7, the latter is connected to the lubricating oil system of the internal combustion engine equipped with a dry sump lubrication. The lubricating oil system consists of a feed line 30 through which lubricating oil is supplied by means of an oil pump 31 interconnected into the same from a tank 32 to the crankcase 33 of the internal combustion engine and is then distributed onto the lubricating places thereof, as well as of a first return line 35 containing an oil cooler 34 which extends from the crankcase 33 to the tank 32. A second return line 36 leads from the cylinder head 1 by way of a throttle 37 and an auxiliary oil pump 38 also to the tank 32. A pressure line 38 to the by-pass valve 7 is connected to this second return line 36 upstream of the throttle 37. A return line 39 starting from the by-pass valve 7 terminates in the first return line 35 and is controlled by a pressure-regulator 40 interconnected into the return line 39, which, in turn, is pneumatically controlled by the pressure difference prevailing at the throttle valve 41.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A multi-cylinder internal combustion engine with externally applied ignition, comprising turbocharger means including turbine and compressor means, a charging air line leading from the compressor means to the cylinder head of the engine including charging air cooler means for cooling the charging air from the turbocharger means ahead of entry into the cylinder head of the internal combustion engine, and an ignition distributor means whose distributor housing means surrounding the same is forcibly traversed with air, the distributor housing means being operatively connected to the charging air line leading from the compressor means of the turbocharger means to the cylinder head and being scavenged by charging air, and further comprising means for keeping the pressure of the charging air substantially constant independently of the geodetic height at which the internal combustion engine finds itself.

2. An internal combustion engine according to claim 1, further comprising bypass valve means interconnected into a bypass line means bypassing the turbine means of the turbocharger means, and said bypass valve means being correspondingly closed with increasing geodetic height.

3. A multi-cylinder internal combustion engine with externally applied ignition, comprising turbocharger means including turbine and compressor means, a charging air line leading from the compressor means to the cylinder head of the engine including charging air cooler means for cooling the charging air from the turbocharger means ahead of entry into the cylinder head of the internal combustion engine, and an ignition distributor means whose distributor housing means surrounding the same is forcibly traversed with air, the distributor housing means being operatively connected to the charging air line leading from the compressor means of the turbocharger means to the cylinder head and being scavenged by charging air, the distributor housing connection means being an interconnection into a bypass line means which branches off from the charging air line upstream of the charging air cooler means and terminates in the charging air line downstream of the charging air cooler means, wherein the distributor housing means comprises two distributor housing means interconnected into the bypass line means and connected in parallel with one another, and further comprising means for keeping the pressure of the charging air substantially constant independently of the geodetic height at which the internal combustion engine finds itself.

4. An internal combustion engine according to claim 1, further comprising bypass valve means interconnected into a further bypass line means bypassing the turbine means of the turbocharger means, and said bypass valve means being correspondingly closed with increasing geodetic height.

5. An internal combustion engine according to claim 4, wherein two distributor housing means are interconnected into the bypass line means which, connected in parallel with one another, are traversed by charging air.

* * * * *